US007418795B2

(12) United States Patent
Caarls et al.

(10) Patent No.: US 7,418,795 B2
(45) Date of Patent: Sep. 2, 2008

(54) ILLUMINATED SIGN

(75) Inventors: Ronald Adrianus Caarls, Ad Haarlem (NL); Peter Van Der Plaat, Ka Vinkeveen (NL)

(73) Assignee: Illuminated Media Systems B.V., Mijdrecht (NL)

( * ) Notice: Subject to any disclaimer, the term of this patent is extended or adjusted under 35 U.S.C. 154(b) by 0 days.

(21) Appl. No.: 10/725,300

(22) Filed: Dec. 1, 2003

(65) Prior Publication Data

US 2004/0172869 A1 Sep. 9, 2004

(30) Foreign Application Priority Data

Nov. 29, 2002 (EP) ..... 02080018

(51) Int. Cl.
*G09F 13/18* (2006.01)

(52) U.S. Cl. ..... 40/546; 362/600

(58) Field of Classification Search ..... 40/547, 40/564, 546; 362/26, 31, 153, 511, 600
See application file for complete search history.

(56) References Cited

U.S. PATENT DOCUMENTS

| | | | | |
|---|---|---|---|---|
| 3,751,319 | A * | 8/1973 | Green et al. | 156/242 |
| 3,968,584 | A | 7/1976 | Kingston | |
| 4,276,705 | A * | 7/1981 | Barth et al. | 40/579 |
| 4,573,766 | A * | 3/1986 | Bournay et al. | 349/65 |
| 4,814,948 | A * | 3/1989 | Hasegawa | 362/581 |
| 4,924,612 | A * | 5/1990 | Kopelman | 40/547 |
| 5,151,679 | A * | 9/1992 | Dimmick | 340/326 |
| 5,398,170 | A * | 3/1995 | Lee | 362/559 |
| 5,536,558 | A | 7/1996 | Shelton | |
| 6,026,602 | A * | 2/2000 | Grondal et al. | 40/570 |
| 6,092,318 | A * | 7/2000 | Arie et al. | 40/547 |
| 6,234,656 | B1 | 5/2001 | Hosseini et al. | |
| 6,305,109 | B1 * | 10/2001 | Lee | 40/546 |

FOREIGN PATENT DOCUMENTS

| | | | |
|---|---|---|---|
| DE | 19818887 | A1 | 11/1999 |
| EP | 0 187 410 | A1 | 7/1986 |
| JP | 2000-347605 | | 12/2000 |
| JP | 2002-286941 | | 10/2002 |
| JP | 2002-286941 | A | 10/2002 |

OTHER PUBLICATIONS

European Patent Office Search Report dated Aug. 22, 2003 (5 pages).

* cited by examiner

*Primary Examiner*—Joanne Silbermann
(74) *Attorney, Agent, or Firm*—Miller, Matthias & Hull

(57) ABSTRACT

An illuminated sign includes a housing and/or a frame, a plate of a light-transmitting material and at least one three-dimensional body, likewise of a light-transmitting material such as a convex strip, in the form of figure, a sign, a decoration or the like, and a light source, which is mounted on the housing and/or the frame. The illuminated sign further includes one or more light guides for coupling light from the light source into the three-dimensional body or bodies. The light guide(s) make(s) it possible to capture light from, for example, one centrally disposed TL tube and couple said light into at least one three-dimensional body, so that an effective lighting of said body is obtained.

16 Claims, 2 Drawing Sheets

ILLUMINATED SIGN

TECHNICAL FIELD

An illuminated sign is disclosed that features a housing and/or a frame, a plate and at least one three-dimensional body, of a light-transmitting material, in the form of figure, a sign, a decoration or the like, and a light source, which is mounted on the housing and/or the frame.

BACKGROUND OF THE RELATED ART

Illuminated signs are known and include a housing, for example in the form of a logo. The housing is provided with a light-transmitting plate, which comprises an opaque coating on the front side, in which openings are present, for example in the form of letters and/or a border. A strip having a convex upper side, which consists of a light-transmitting paste, is applied in said openings. Fluorescent or thin light (hereinafter "TL") tubes are mounted across the width of the plate, at least under the openings. The TL tubes cause the convex strips to light up when they are turned on, making said strips resemble neon tubes.

Existing illuminated signs are relatively complex and heavy, because a large number of TL tubes are required in order to provide sufficient lighting of the strips. In addition, the tubes must frequently be arranged in such a manner that that they conform to the shape of, for example, a border as well as possible.

As a result, there is a need for an improved illuminated sign as an alternative to those discussed above.

SUMMARY OF THE DISCLOSURE

To this end, an illuminated sign is disclosed which is characterized in that said illuminated sign comprises one or more light guides for coupling light from the light source into the three-dimensional body or bodies.

The light guide(s) make(s) it possible to capture light from, for example, one centrally disposed TL tube and couple said light into at least one three-dimensional body, so that an effective lighting of said body is obtained. If a suitable material is selected, such as a strip of a light-transmitting polymer, the disclosed sign moreover provides much greater freedom as regards the design of a logo.

One disclosed light guide preferably comprises a surface for coupling light into the three-dimensional body, which surface is optically coupled to the three-dimensional body and which conforms to the shape thereof, preferably along the entire length thereof along the main part of the length of said body.

Furthermore, the width of said surface is preferably smaller than the width of the body, preferably it amounts to 70% or less, or even 50% or less, of the width of the body. Thus a very effective coupling of light from the light guide into the three-dimensional body is obtained, and the resemblance to neon lighting in particular colours, especially red, in which the tube lights up more brightly in the centre, can be further enhanced.

As a result, is possible to obtain an aureole by selecting a width for said surface which is greater rather than smaller than that of said body.

Within this framework, the term "light-transmitting" is understood to mean both transparent and translucent (e.g., milky).

BRIEF DESCRIPTION OF THE DRAWINGS

The disclosed signs will now be explained in more detail by means of three preferred embodiments as shown in the following figures, wherein.

DETAILED DESCRIPTION OF THE PRESENTLY PREFERRED EMBODIMENTS

Figure 1:
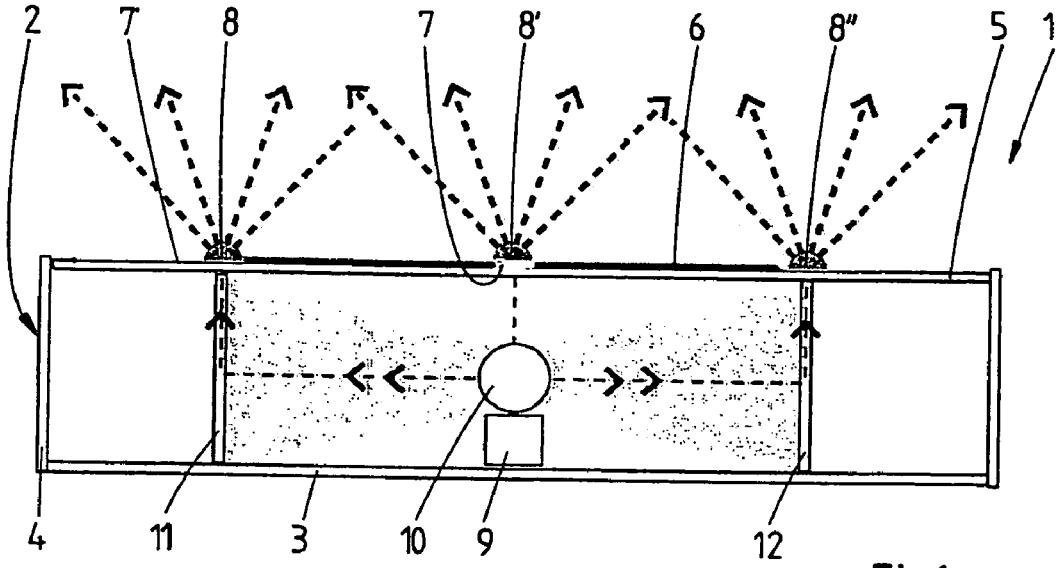
FIG. 1 is a cross-sectional view of a first illuminated sign according to a first disclosed embodiment.
Figure 2:
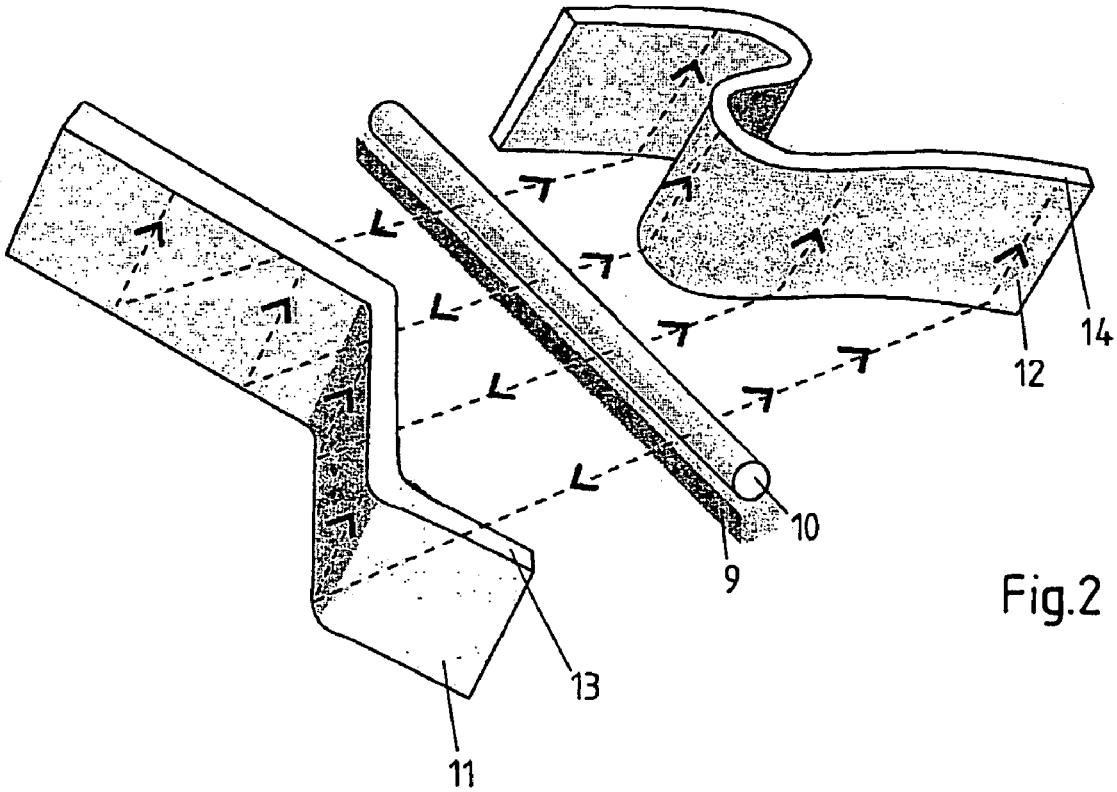
FIG. 2 is a perspective view of the interior of the illuminated sign according to FIG. 1.

FIG. 1 is a cross-sectional view of a first illuminated sign and FIG. 2 is a perspective view of the internal parts of said illuminated sign. The illuminated sign 1 comprises a housing 2 with a bottom plate 3 and, along the circumference of the bottom plate 3, a side plate 4. The illuminated sign 1 furthermore comprises a front plate 5, for example of a clear polymer, such as acrylate. The form of the front plate 5, for example a logo, corresponds to that of the bottom plate 3. An opaque layer 6 has been coated onto the front side of the front plate 5, preferably by screen-printing or offset printing. The layer 6 comprises an opening 7 and edge zones 7', in which three-dimensional bodies, in this case convex strips 8 of a known UV-hardening or self-hardening paste are arranged. Centrally arranged in the housing 2 is a fitting 9 (schematically shown), to which a single TL tube 10 is mounted.

The TL tube 10, which is positioned directly below the central strip 8', is flanked on either side by light guides 11, 12, in this case strips of rectangular section having end surfaces 13, 14 which are relatively narrow in comparison with the width of the strips 8. The light guides 11, 12 are positioned directly below the left-hand and right-hand strips 8, 8", and they are bent so that the upper end surfaces 13, 14 conform to the shape of said strips 8, 8". The light guides 11, 12 in this example are made of a translucent acrylate, to which a fluorescent substance has been added. The width of said end surfaces 13, 14 of the light conductors 11 and 12 is less than 50%, for example, of the width of the strips 8 to which they are optically coupled.

When the TL tube 10 is turned on, light (illustrated in dotted lines) from said tube 10 will directly couple into the middle strip 8' and illuminate the lateral surfaces of the guides 11 and 12. Via said lateral surfaces the light from the TL tube 10 will couple into the guides 11 and 12, be retained therein, be guided upwards and downwards and be coupled out at the end surfaces. In order to reduce or even eliminate losses at the bottom side of the guides 11, 12, the lower end surfaces may be provided with a reflective layer or be formed or ground so that light will inherently be reflected. As a result of the relatively small width of the end surfaces 13, 14, the resemblance to neon lighting, in particular red lighting, in which the tube lights up more brightly in the center, is enhanced.

Figure 3:
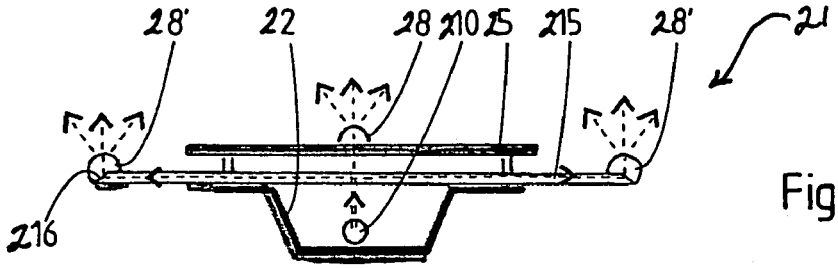
FIGS. 3 and 4 are cross-sectional views of second and third illuminated signs according to this disclosure.

FIG. 3 shows a second illuminated sign 21 in which two at least partially transparent plates 215, 25 are fixed to the front side of the housing 22. The first plate 25 is again made of a clear polymer, such as acrylate, and provided with a coating comprising one or more openings. A three-dimensional body, such as a convex strips 28 of a translucent paste is, is arranged in each of the openings. The first plate 25 is fixed to the second plate 215, which in turn is fixed to the housing 22. The first plate 25 may be directly fixed to the housing 22 through holes in the second plate 215.

Figure 5:
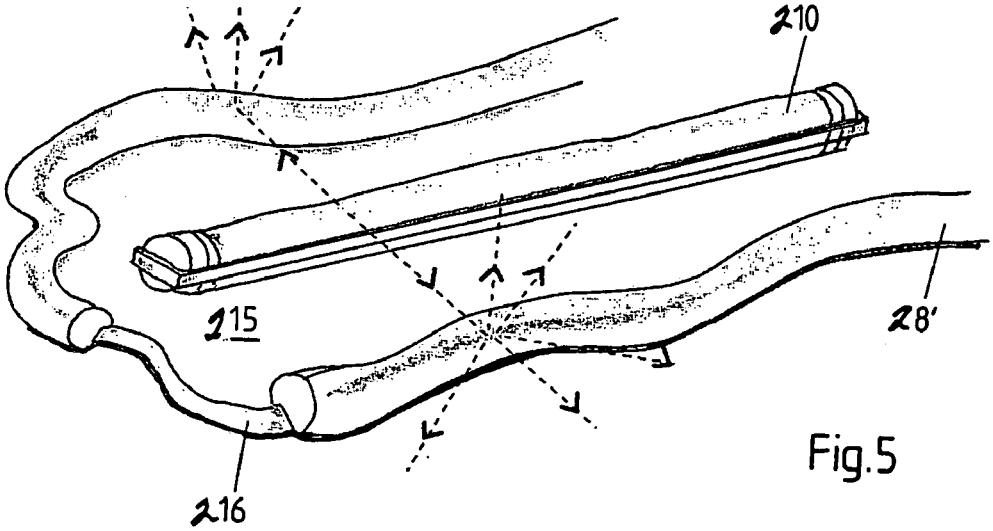
FIG. 5 is a perspective view of a part of the illuminated sign of FIG. 4.

Also the second plate 215 is made of a clear polymer. As best shown in FIG. 5, the edge 216 of said plate 215 may have a random shape, for example a shape corresponding to a logo. A strip 28' of the aforesaid paste is applied along the circumference of the second plate 215. Returning to FIG. 3, when the TL tube 210 is turned on, a part of the light from said tube 210 will illuminate the middle strip 28 through the transparent plate 215 and the openings in the plate 25, whilst another part of said light will couple into the second plate 215 and couple out of said second plate 215 at the circumference thereof to illuminate the strip 28' along the circumference. The edge of the second plate 215 may be bevelled for the purpose of improving and/or directing said coupling of light to the latter strip 28'.

Figure 4:
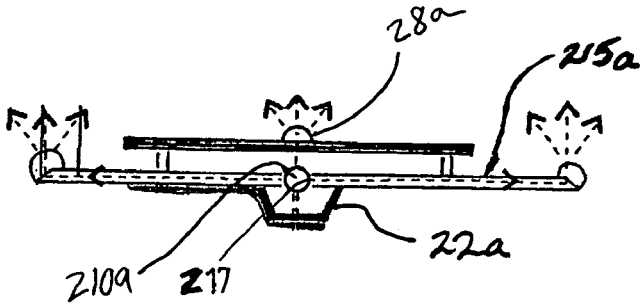

FIGS. 4 and 5 show a third sign, which corresponds in large measure to the second embodiment shown in FIG. 3, with this difference that, as is also shown in FIG. 5, the TL tube 210*a* is not arranged under the second plate 215*a* but rather in an opening 217 in the second plate 215*a*. Thus the coupling of light into the second plate 215*a* is improved, making it possible to use a smaller housing 22*a* or substitute said housing for a frame, for example a frame consisting of a single section.

With the embodiments according to FIGS. 4 and 5, an observer may have the impression that the strip 28*a* is hardly supported, if at all, by a fitting or a light box, in other words, appears to float, just like a neon tube. Interrupting the strip may further enhance the resemblance to neon tubes, so that it seems as if the strip, just like a neon tube, bends backwards at the location of the interruption so as to be connected to a power supply.

This disclosure is not restricted to the specific embodiments described above, which, of course, which can be varied in many ways but still fall within the scope of this disclosure. For example, the housing may be internally coated with a reflective layer. Furthermore, different shapes of the guides are possible, for example guides in the form of a bar of triangular section, one surface being directed to the light source and one surface being directed to a three-dimensional body, with the third surface mainly functioning as a reflector. The light-transmitting plates may also be curved or convex instead of flat.

What is claimed:

1. An illuminated sign comprising:

a housing, a front plate mounted to the housing, at least one three-dimensional body of a light-transmitting material, a light source, at least one light guide for coupling light from the light source to the at least one three-dimensional body, the light guide comprising a plate-like structure having an outer edge and being made from a light-transmitting material, the plate-like structure of the light guide extending at least substantially parallel to and laterally beyond an edge of the front plate and the light guide engaging the at least one three-dimensional body laterally beyond an edge of the front plate the three-dimensional body being disposed along at least a portion of the outer edge of the light guide.

2. The illuminated sign according to claim 1, wherein the at least one light guide comprises an end surface for directing light received into the light guide from the light source and into the three-dimensional body, and wherein said end surface is optically coupled to the three-dimensional body and conforms to the shape thereof.

3. The illuminated sign according to claim 2, wherein a width of said end surface is smaller than a width of said three dimensional body.

4. The illuminated sign according to claim 1, wherein said edge of the plate-like structure is bevelled.

5. The illuminated sign according to claim 1, wherein said plate-like structure comprises a recess in which the light source is disposed.

6. The illuminated sign according to claim 1, wherein at least part of the front plate is opaque.

7. The illuminated sign according to claim 6, wherein an opaque layer is disposed on the front plate with at least one opening provided through the layer exposing the front plate, and wherein another three-dimensional body is disposed on said opening, and wherein the light guide and the three dimensional body connected thereto are disposed between the housing and the front plate but laterally spaced beyond the front plate so the opaque layer does not block or cover the three-dimensional object connected to the light guide.

8. The illuminated sign according to claim 1, wherein the light guide contains a fluorescent substance.

9. The illuminated sign according to claim 1, wherein said three-dimensional body consists of a paste.

10. The illuminated sign according to claim 9, wherein the paste is one of a UV-hardening or a self-hardening paste.

11. An illuminated sign comprising:

a housing, a front plate of a light-transmitting material mounted to the housing, at least one three-dimensional body of a light-transmitting material, a light source, at least one light guide for coupling light from the light source to the at least one three-dimensional body, the at least one light guide comprising a plate-like structure which extends at least substantially parallel to and laterally beyond an edge of the front plate, the plate-like structure of the at least one light guide comprising a bevelled edge, and wherein the at least one three-dimensional body engages the bevelled edge of the plate-like structure of the at least one light guide laterally beyond an edge of the front plate.

12. The illuminated sign according to claim 11, wherein the plate-like structure comprises a recess in which the light source is disposed.

13. The illuminated sign according to claim 11, wherein at least part of the front plate is opaque.

14. The illuminated sign according to claim 13, wherein an opaque layer is disposed on the front plate with at least one opening provided through the layer exposing the front plate, and wherein another three-dimensional body is disposed on the opening, and wherein the bevelled edge of the light guide and the three dimensional body connected thereto are disposed between the housing and the front plate but laterally spaced beyond the front plate so the opaque layer does not block or cover the bevelled edge or three-dimensional object connected thereto.

15. The illuminated sign according to claim 11, wherein the light guide contains a fluorescent substance.

16. The illuminated sign according to claim 11, wherein the at least one three-dimensional body comprises a light-transmitting material.

* * * * *